US006658204B2

(12) United States Patent
Schurter et al.

(10) Patent No.: US 6,658,204 B2
(45) Date of Patent: Dec. 2, 2003

(54) DOOR INSULATOR WITH SAFETY PLUG

(75) Inventors: Robert M. Schurter, Colgate, WI (US); Benjamin J. Bolton, Elm Grove, WI (US)

(73) Assignee: AOS Holding Company, Wilmington, DE (US)

( * ) Notice: Subject to any disclaimer, the term of this patent is extended or adjusted under 35 U.S.C. 154(b) by 0 days.

(21) Appl. No.: 10/123,712

(22) Filed: Apr. 16, 2002

(65) Prior Publication Data

US 2003/0194227 A1 Oct. 16, 2003

(51) Int. Cl.[7] ..... F24H 1/18
(52) U.S. Cl. ..... 392/441; 392/449
(58) Field of Search ..... 392/411, 449

(56) References Cited

U.S. PATENT DOCUMENTS

| | | | |
|---|---|---|---|
| 2,439,708 | A | 4/1948 | Abraham |
| 3,832,676 | A | 8/1974 | Joly |
| 3,848,088 | A | 11/1974 | Bentz |
| 4,542,372 | A | 9/1985 | Takach, Jr. |
| 4,990,888 | A | 2/1991 | Vogt et al. |
| 5,163,119 | A | 11/1992 | Windon |
| 5,293,844 | A | 3/1994 | Threatt |
| 5,299,280 | A | 3/1994 | Ruark |
| 5,476,392 | A | 12/1995 | Inaba et al. |
| 5,762,512 | A | 6/1998 | Trant et al. |
| 5,820,413 | A | 10/1998 | Yamada et al. |
| 5,848,904 | A | 12/1998 | Kikuchi |

*Primary Examiner*—Thor Campbell
(74) *Attorney, Agent, or Firm*—Michael Best & Friedrich LLP

(57) ABSTRACT

A water heater that includes a tank, an electrical component, and an electrical circuit. The tank defines a water chamber and includes an outer surface. The electrical component is coupled to the outer surface of the tank and extends from the outer surface of the tank. The electrical circuit electrically connects the electrical component and provides electricity to the electrical component when the electrical circuit is closed and does not provide electricity to the electrical component when the electrical circuit is open. A door assembly is movable between an open position and a closed position, and the door assembly includes a connecting device mounted to the door assembly. The connecting device closes the electrical circuit when the door assembly is in the closed position and opens the electrical circuit when the door assembly is in the open position.

26 Claims, 6 Drawing Sheets

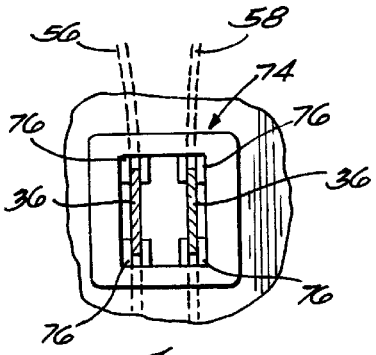
Fig. 3
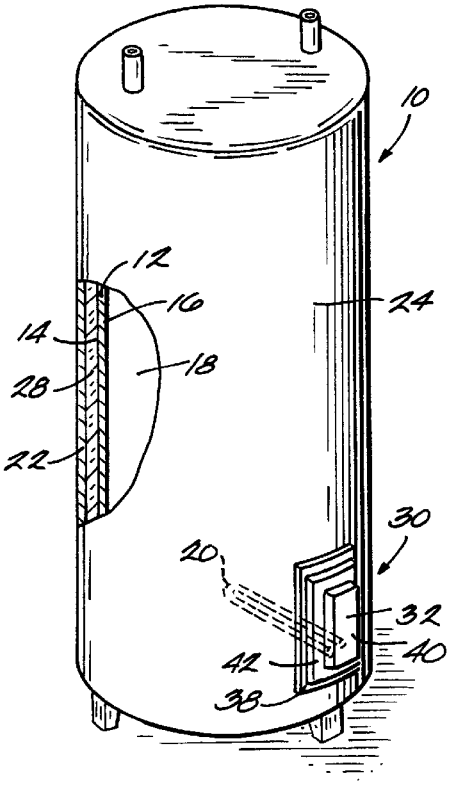
Fig. 1
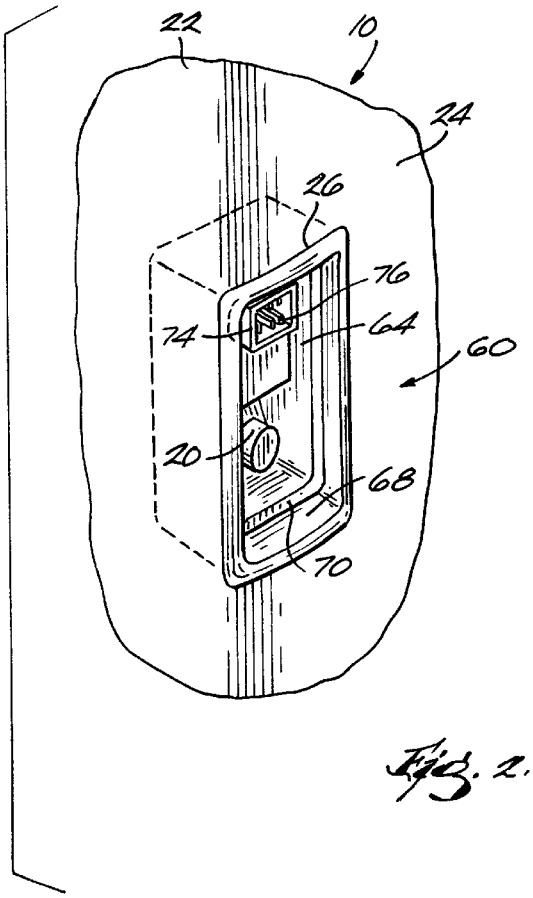
Fig. 2.
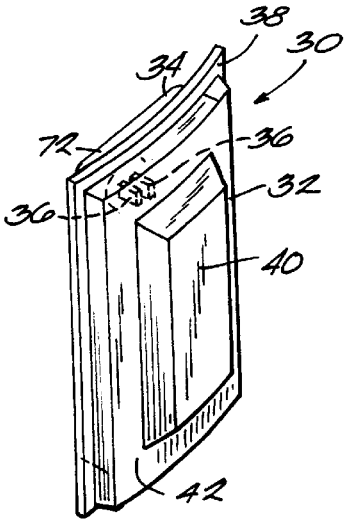

DOOR INSULATOR WITH SAFETY PLUG

FIELD OF THE INVENTION

The invention relates to water heaters, and more particularly to water heaters having doors that provide access to electrical components mounted within the water heaters.

BACKGROUND OF THE INVENTION

It is known to provide water heaters with a tank, a jacket that surrounds the tank, and an electrical component, such as a thermostat or a heating element. The electrical component is coupled to the tank and is accessible through an opening in the jacket. The opening of the jacket is typically covered by a removable door. The door is movable between an open position providing access to the opening and a closed position restricting access to the opening.

It is also known to provide a polystyrene dam that surrounds the electrical component and that extends between the tank and the jacket to protect the electrical component from the insulating foam while the foam is injected between the tank and the jacket. Thus, the dam at least partially defines the opening. In addition, it is known to insert a polystyrene cap into the opening of the jacket and within the dam to further insulate the tank from the environment.

SUMMARY OF THE INVENTION

The water heater of the present invention increases safety and decreases the likelihood of electrocution during water heater maintenance by providing a door assembly that selectively opens and closes an electrical circuit providing electricity to an electrical component of the water heater. More specifically, when the door assembly is removed to gain access to the electrical component, the electrical circuit is opened, and when the door assembly is closed, the electrical circuit is closed.

The door assembly also eliminates the need for a permanently fixed dam around the electrical component by providing a dam that is moldable to a door of the door assembly. The dam is shaped to closely cover and surround the electrical component and to provide the necessary seal against the tank and jacket during the injection of the insulation foam between the tank and the jacket. The dam may optionally be sprayed or coated with a release agent so that the dam does not bond with the injected insulation, thereby allowing the cover assembly to be removed after the insulation foam cures.

In an alternate configuration of the water heater, a conventional foam dam is positioned within an opening in the jacket to protect the electrical component of a water heater from insulating foam during injection of the foam between the tank and the jacket of the water heater. The door assembly includes a ceramic foam insulating cap that is molded to the door and that is insertable in the dam to provide rigidity to the dam and to maintain the shape of the dam under high forces that are generated by injecting a thick layer of insulation between the tank and the jacket. The ceramic foam insulating cap also improves the insulating effect of the door assembly on the water heater.

Other features and advantages of the invention will become apparent to those skilled in the art upon review of the following detailed description, claims and drawings.

BRIEF DESCRIPTION OF THE DRAWINGS

FIG. 1 is a perspective view illustrating a water heater embodying the invention.

FIG. 3 is an enlarged view of a plug of the water heater.

FIG. 7 is a cross-section view taken along line 7—7 in FIG. 5.

Figure 2:
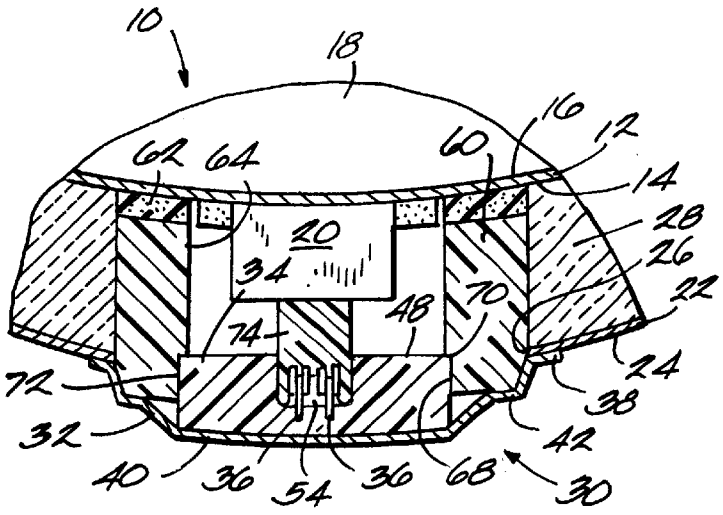
FIG. 2 is an enlarged exploded view of a portion of the water heater.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify elements of a method or process is simply for identification and is not meant to indicate that the elements should be performed in a particular order.

DETAILED DESCRIPTION

A water heater 10 embodying the invention is illustrated in the drawings. As shown in FIG. 1, the water heater 10 comprises a tank 12 including an outer surface 14 and an inner surface 16 that defines a water chamber 18. The water heater 10 also comprises an electrical component 20 such as a thermostat or a heating element, extending at least in part outwardly of the outer surface 14 of the tank 12. The illustrated water heater 10 is an electric water heater and includes both a thermostat and a heating element. It should be noted that the invention can also be utilized with a gas water heater which includes an electrical component such as a thermostat.

The water heater 10 further comprises a jacket 22 surrounding the tank 12. The jacket 22 includes an outer surface 24 and has an opening 26 that allows access to the electrical component 20 (FIG. 2). In the illustrated construction, the opening 26 is rectangular. As shown in FIG. 1, a layer of foam insulating material 28 is located between the tank 12 and the jacket 22. The manner in which the insulating material 28 is placed between the tank 12 and the jacket 22 is described in greater detail below.

Figure 4:
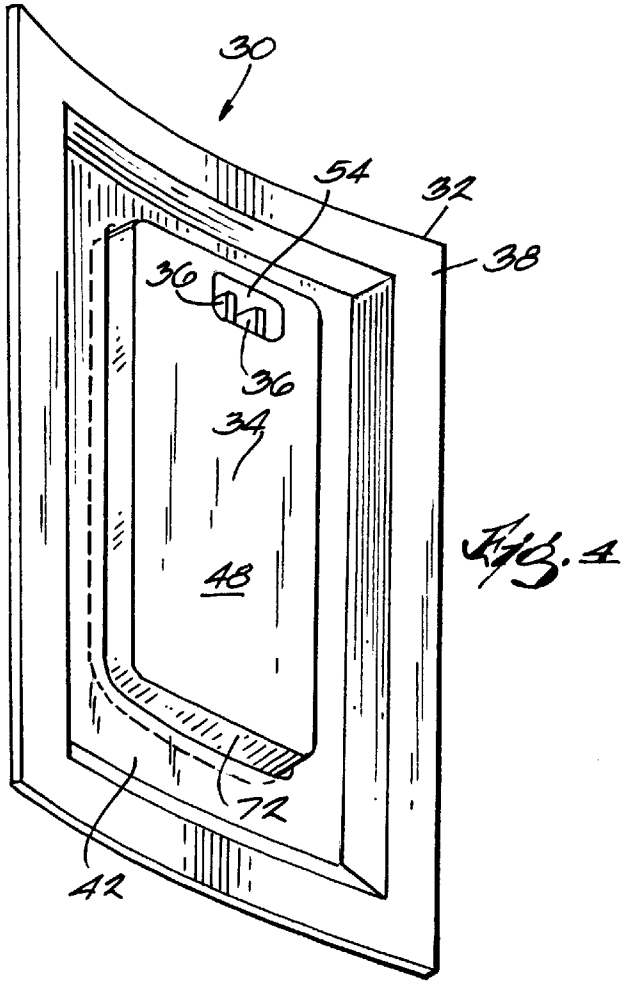
FIG. 4 is a rear perspective view illustrating the door assembly of the water heater.

The water heater 10 further comprises a door assembly 30 which is removably mounted on the jacket 22 such that the door assembly 30 is movable between an open position (FIG. 2) that allows access to the opening 26 and the electrical component 20, and a closed position (FIG. 5) that restricts access to the opening 26 and the electrical component 20. As best shown in FIG. 4, the door assembly 30 includes a door 32, an insulating cap 34, and a connecting device, such as electrical conduits 36. With reference to FIG. 6, the door 32 has an outer flange portion 38 engaging the outer surface 24 of the jacket 22, a central portion 40 spaced a distance from the outer surface 24 of the jacket 22, and an intermediate portion 42 which is located between the central portion 40 and the outer flange portion 38. The door 32 is removably secured to the jacket 22 by a plurality of screws 44 or other suitable fasteners (e.g., bolts, clips, studs, nuts, etc.) extending through holes 46 located in the intermediate portion 42 and the jacket 22. The door 32 is preferably stamped from sheet metal, such as aluminum or stainless steel.

Referring back to FIG. 4, the insulating cap 34 is connected to the central portion 40 of the door 32. The insulating cap 34 includes an inner surface 48 that is spaced a distance from the door 32. The insulating cap 34 is preferably molded to the door 32 and is molded from materials that are electrically non-conductive and that are poor thermal conductors. Alternatively, the cap 34 could be a separate piece from the door 32.

Figure 5:
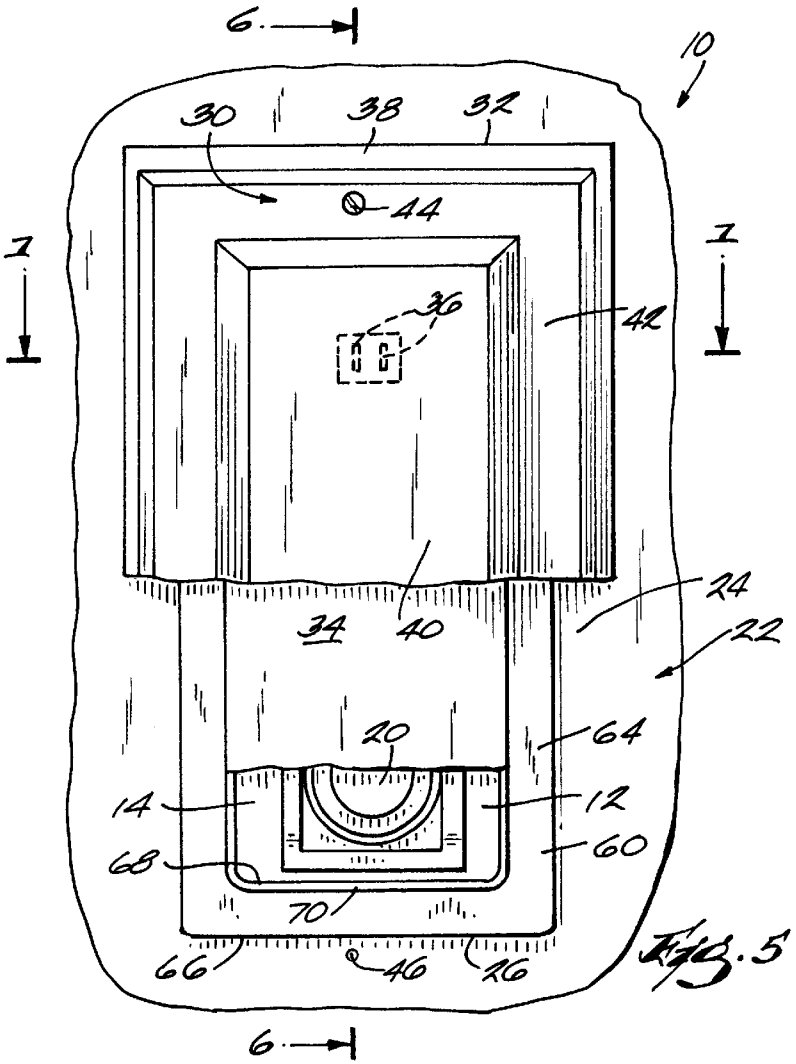
FIG. 5 is an enlarged partial cutaway view of a portion of the water heater.
Figure 6:
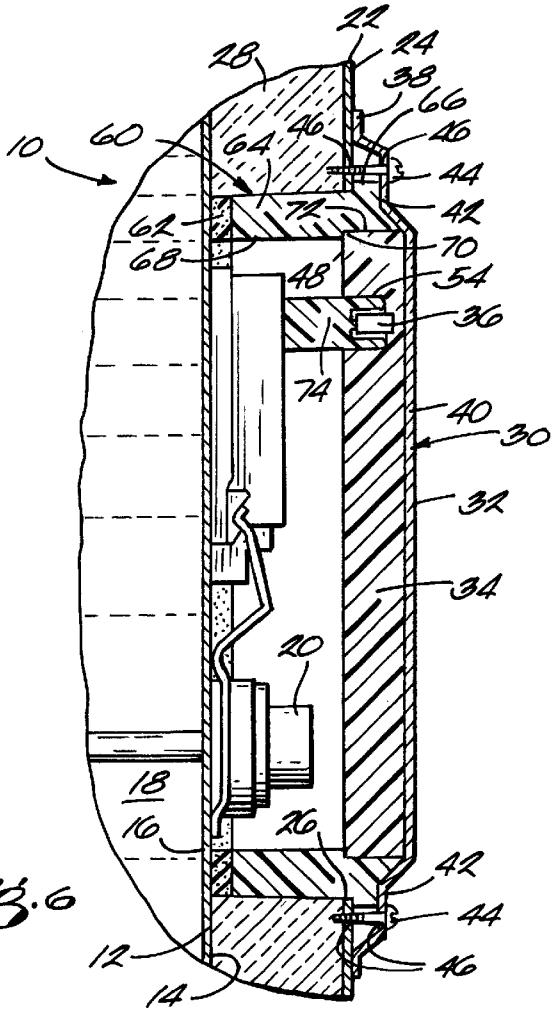
FIG. 6 is a cross-section view taken along line 6—6 in FIG. 5.
Figure 8:
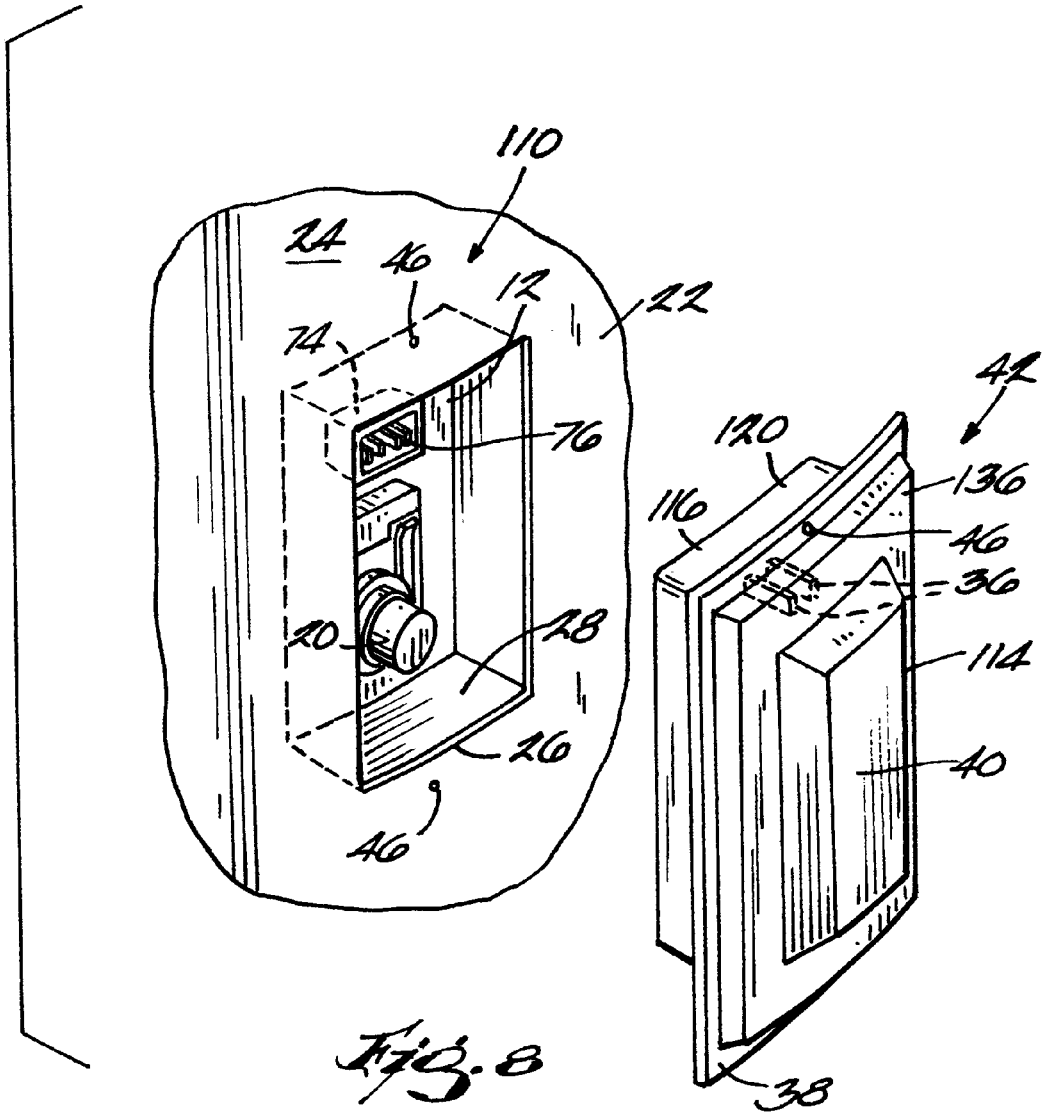
FIG. 8 is an enlarged exploded view of a portion of a water heater according to another embodiment of the invention.
Figure 12:
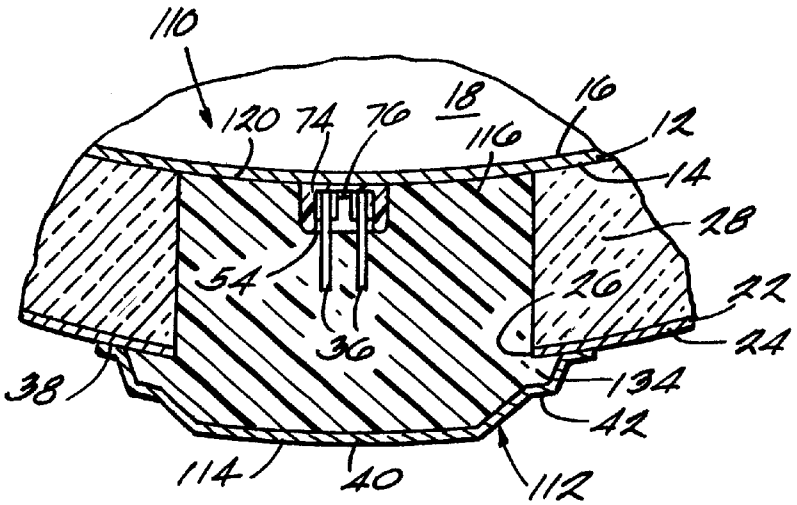
FIG. 12 is a cross-section view taken along line 12—12 in FIG. 10.

With reference to FIGS. 4–6, the insulating cap 34 also includes a socket 54 that contains the conduits 36. The electrical conduits 36 have portions embedded within the insulating cap 34 and exposed portion within the socket 54. The conduits 36 are generally parallel to each other and do not extend out of the socket 54.

As shown in FIG. 2, the water heater 10 further comprises a dam 60 within the opening 26 and surrounding the electrical component 20. The dam 60 extends between the tank 12 and the jacket 22. The dam 60 is preferably rectangular and fits snugly within the opening 26.

As shown in FIGS. 6 and 7, the dam 60 includes a flexible inner portion 62 sealingly engaging the outer surface 14 of the tank 12. The inner portion 62 is preferably made of flexible urethane. The dam 60 also includes an outer portion 64 made of expandable polystyrene and fixed to the inner portion 62 by suitable means such as adhesive. The outer portion 64 includes, adjacent the outer end thereof, a lip 66 extending between the door 32 and the jacket 22 (FIG. 6). More particularly, the lip 66 extends between the intermediate portion 42 of the door 32 and the outer surface 24 of the jacket 22, and the lip 66 is compressed between the door 32 and the outer surface 24 of the jacket 22. The lip 66 consequently sealingly engages the outer surface 24 of the jacket 22 when the door assembly 30 is closed. The outer portion 64 of the dam 60 also includes inner walls 68 that include a shoulder 70 and that define a space containing the electrical component 20.

When the door assembly 30 is in the closed position (FIGS. 1, 4–7), the inner surface 48 of the insulating cap 34 engages the shoulder 70, and outer walls 72 of the insulating cap 34 engage the inner walls 68 of the dam 60. More particularly, the outer walls 72 of the insulating cap 34 are wedged against the inner walls 68 of the dam 60. The portion of the inner walls 68 that receive the insulating cap 34 are preferably tapered in the direction toward the tank 12 and toward the inside of the dam 60 so that the insulating cap 34 is forced against the dam 30 inner walls 68. The insulating cap 34 is configured to closely cover the electrical component 20 when the door assembly 30 is in the closed position to maximize the insulating properties of the insulating cap 34.

The water heater 10 includes an electrical circuit (not shown) that is electrically connected to the electrical component 20. The electrical circuit is also electrically connected to a power source (not shown). The electrical circuit provides electricity to the electrical component 20 when the electrical circuit is closed and does not supply electricity to the electrical component when the electrical circuit is open.

As shown in FIGS. 2 and 3, the electrical component 20 includes a hollow plug 74 that extends from the electrical component 20 and that includes four pairs of contacts 76 which are positioned within the plug 74 and connected to the electrical circuit. When the door assembly 30 is closed, as shown in FIGS. 6 and 7, the plug 74 is inserted into the socket 54 such that one of the electrical conduits 36 is inserted between the first and second contacts 76 and the other electrical conduit 36 is inserted between the third and fourth contacts 76. Connection of the electrical conduit 36 with the contacts 76 of the plug 74 closes the electrical circuit thereby providing electricity to the electrical component 20. Conversely, when the door assembly 30 is opened, as shown in FIG. 2, the plug 74 is removed from the socket 54 removing the electrical conduit 36 from contact with the contacts 76 so that no electricity is provided to the electrical component 20. In addition to opening and closing the circuit, the plug 74 and socket 54 arrangement can also be configured to secure the door assembly 30 in the closed position.

The present invention is not limited to the plug 74 and socket 54 arrangement of the illustrated embodiment. Rather, other structures known to those skilled in the art can be used to close the electrical circuit when the door assembly 30 is in the closed position, such as, for example, a spring contact.

Typically, the electrical circuit will be connected to a 220-volt power source thereby providing 110 volts through a wire 56 connected to the first contact 76 and 110 volts through a wire 58 connected to the second contact 76. Therefore, to completely disconnect the electrical component from electricity, both wires 56, 58 must be disconnected from the electrical component 20.

Disconnecting the electrical component 20 from the power source of the electrical circuit by removing the door assembly 30 is advantageous because it reduces the risk of electrocution when the electrical component 20 is made accessible for adjustment or maintenance. Therefore, the electrical component 20 will not be supplied with electricity when the door assembly 30 is removed.

The water heater 10 is assembled as follows. First, the tank 12, the electrical component 20, the jacket 22, and the dam 60 are arranged as described above. Next, the door assembly 30 is secured over the opening 26 so that the lip 66 of the dam 60 is compressed between the door 32 and the jacket 22. By securing the door assembly 30, the insulating cap 34 is inserted into the dam 60 and the plug 74 is inserted into the socket 54 as described above. Last, insulating foam 28 is injected between the tank 12 and the jacket 22 and around the dam 60 to provide insulation between the tank 12 and the jacket 22. Because the dam 60 sealingly engages both the tank 12 and the jacket 22, the dam 60 keeps substantially all of the foam 28 outside of the cavity 50 and thereby substantially prevents the foam 28 from reaching the electrical component 20.

To enhance the performance and efficiency of the water heater 10, it has become necessary to increase the thickness of the insulating foam 28 between the tank 12 and the jacket 22. Increasing the thickness of the insulating foam 28 also increases the pressure that is exerted on the dam 60 and insulating cap 34 by the foam 28 during the injection process. In order for the dam 60 and the insulating cap 34 to withstand this increase in pressure, the insulating cap 34 is preferably molded from a ceramic foam to improve the strength and insulation characteristics of the insulating cap 34. Specifically, the ceramic foam insulating cap 34 rigidifies the dam 60 and helps the dam 60 to resist the force exerted on the dam 60 by the foam 28 during injection of the foam 28.

An alternative construction of a water heater 110 is illustrated in FIGS. 8–12. In this embodiment of the invention, the water heater 110 includes a door assembly 112 having a door 114, a dam 116 connected to the door 114, and a connecting device, such as electrical conduits 36. The dam 116 replaces the dam 60 and insulating cap 34 arrangement of the water heater 10 illustrated in FIGS. 1–7 and serves the functions of both the dam 60 and the insulating cap 34. As most of the elements of the water heater 110 remain identical to the water heater 10, identical reference numerals are used in FIGS. 8–12 to identify features common to both illustrated embodiments, and the description of the common features will not be repeated.

Figure 9:
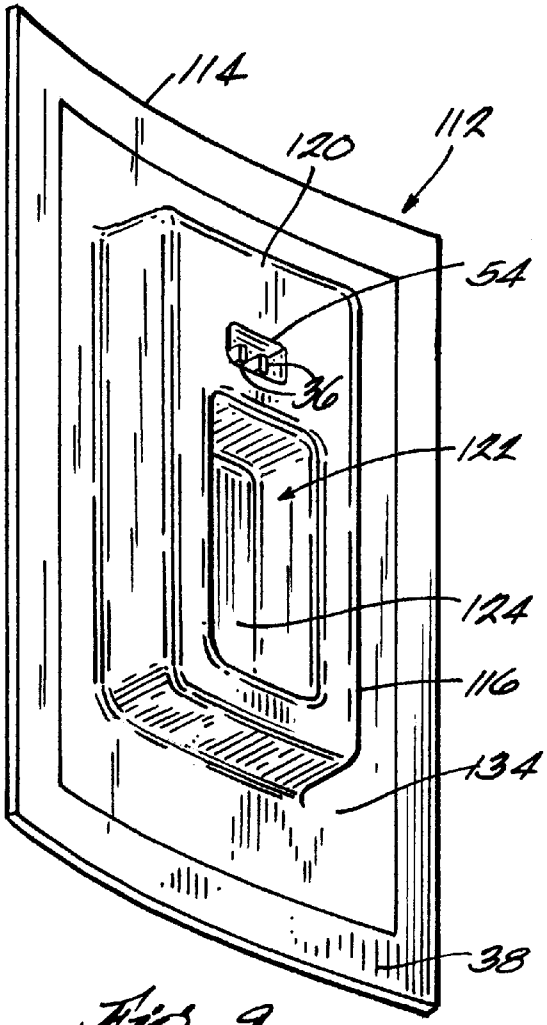
FIG. 9 is an enlarged rear perspective view illustrating a door assembly of the water heater shown in FIG. 8.
Figure 10:
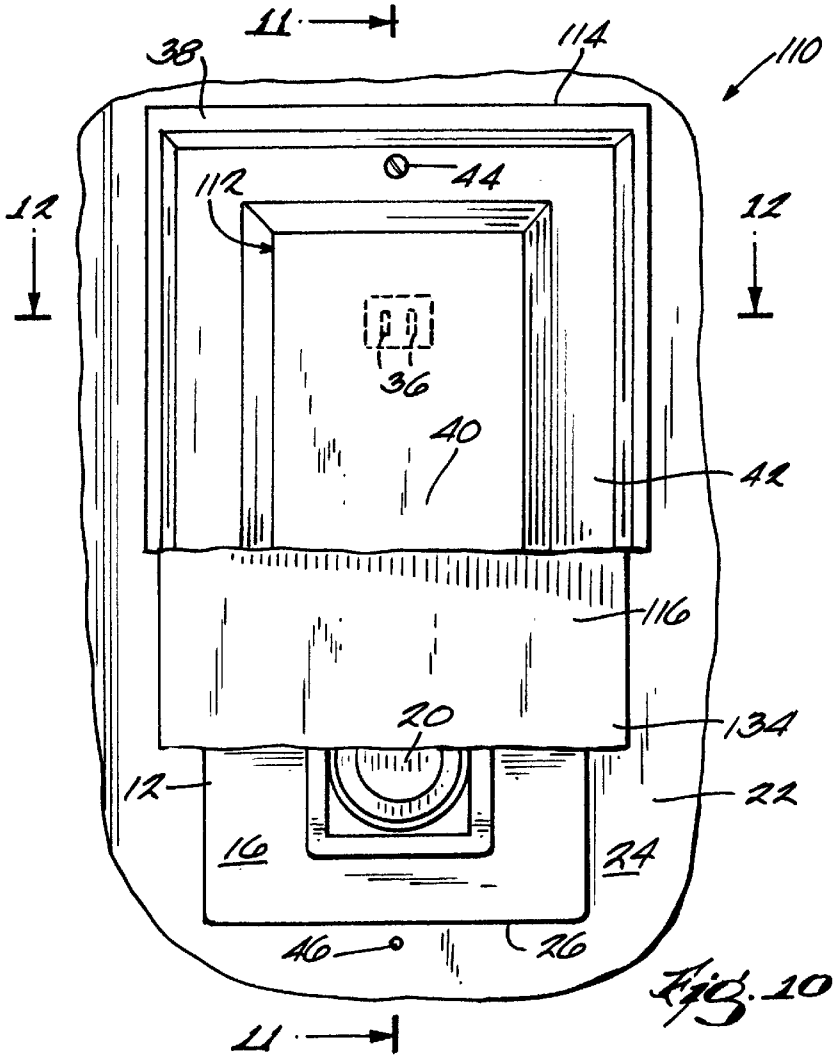
FIG. 10 is an enlarged partial cutaway view illustrating a portion of the water heater shown in FIG. 8.
Figure 11:
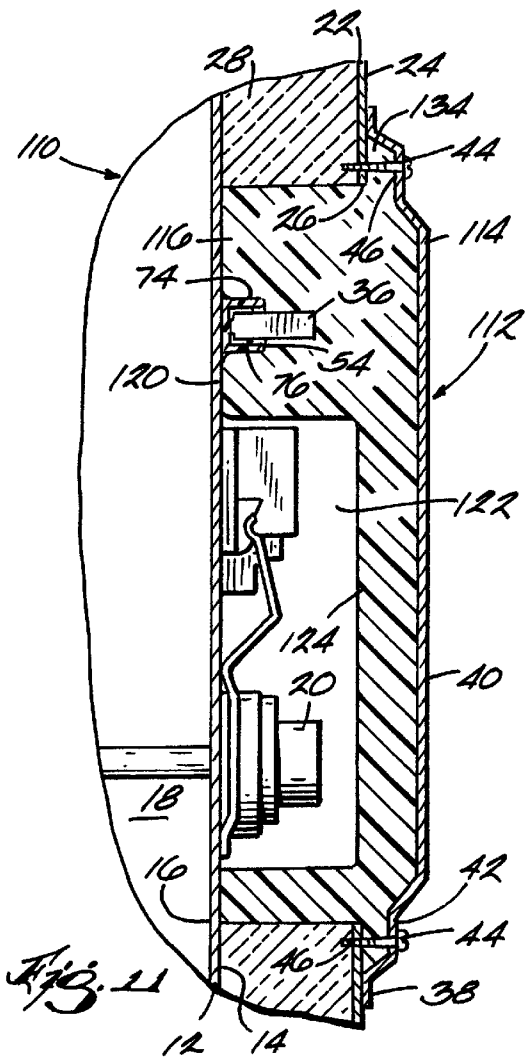
FIG. 11 is a cross-section view taken along line 11—11 in FIG. 10.

As shown in FIG. 9, the dam 116 is connected to the door 114 and includes a concave inner surface 120 that is spaced a distance from the door 114. The dam 116 includes a rectangular cavity 122 that is recessed from the inner surface 120 toward the door 114 thereby defining a first recessed wall 124. The dam 116 is preferably molded directly to the door 114, and preferably molded from ceramic foam or urethane foam. However, the dam 116 can be molded from other materials that are electrically non-conductive, that are poor thermal conductors, and that are substantially rigid to withstand the pressures exerted on the dam 116 during injection of the insulating foam 28. The dam 116 also includes a socket 54 that is recessed from the first inner surface 120.

The door assembly 112 is movable between the open and closed position and is movable to open and close the electrical circuit in the same manner as described above with respect to the water heater 10. The cavity 122 is configured to closely cover the electrical component 20 when the door assembly 112 is in the closed position to maximize the insulating properties of the dam 116.

The dam 116 includes a lip 134 extending between the door 114 and the jacket 22. More particularly, the lip 134 extends between an intermediate portion 42 of the door 114 and the outer surface 24 of the jacket 22, and the lip 134 is compressed between the door 114 and the outer surface 24 of the jacket 22. The lip 134 consequently sealingly engages the outer surface 24 of the jacket 22.

The water heater 110 is assembled as follows. First, the tank 12, the electrical component 20, and the jacket 22 are arranged as described above. Next, the door assembly 112 is secured over the opening 26 so that the lip 134 of the dam 116 is compressed between the door 114 and the jacket 22. By securing the door assembly 112 to the jacket 22, the concave inner surface 120 of the dam 116 snugly engages the outer surface 14 of the tank 12 and the plug 74 is inserted into the socket 54. Last, insulating foam 28 is injected between the tank 12 and the jacket 22 and around the dam 116 to provide insulation between the tank 12 and the jacket 22. Because the dam 116 sealingly engages both the tank 12 and the jacket 22, the dam 116 keeps substantially all of the foam 28 outside of the dam 116 and thereby substantially prevents the foam 28 from reaching the electrical component 20. In order to prevent the dam 116 from bonding to the injected foam 28, the dam 116 is coated with a releasing agent prior to injecting the insulating foam 28 so that the door assembly 112 can be opened and the dam 116 can be removed from the jacket 22.

We claim:

1. A water heater comprising:

a tank defining a water chamber, the tank including an outer surface;

an electrical component coupled to the outer surface of the tank, the electrical component extending from the outer surface of the tank;

an electrical circuit electrically connected to the electrical component, the electrical circuit providing electricity to the electrical component when the electrical circuit is closed and not providing electricity to the electrical component when the electrical circuit is open; and a door assembly movable between an open position in which the door assembly provides access to the electrical component and a closed position in which the door assembly restricts access to the electrical component, the door assembly including a connecting device closing the electrical circuit when the door assembly is in the closed position and opening the electrical circuit when the door assembly is in the open position.

2. The water heater of claim 1, wherein the electrical component is a thermostat.

3. The water heater of claim 1, wherein the electrical component is a heating element.

4. The water heater of claim 1, wherein the door assembly includes a door having an inner surface, and an insulating cap.

5. The water heater of claim 4, wherein the insulating cap is molded to the inner surface of the door.

6. The water heater of claim 4, further comprising a jacket surrounding the tank, the jacket including an opening providing access to the electrical component, wherein the door assembly provides access to the opening in the open position and restricts access to the opening in the closed position;

a dam positioned in the opening, the dam including interior walls that define a space containing the electrical component; and insulating material located between the tank and the jacket and outside of the dam.

7. The water heater of claim 6, wherein the insulating cap extends over the electrical component and engages the interior walls of the dam so that the insulating cap insulates the tank and rigidifies the dam when the door assembly is in the closed position.

8. The water heater of claim 4, wherein the connecting device is connected to the insulating cap.

9. The water heater of claim 8, wherein the connecting device is co-molded with the insulating cap.

10. The water heater of claim 8, wherein the connecting device is an electrical conduit, wherein the electrical component includes electrical contacts, and wherein the electrical contacts are electrically connected to each other with the electrical conduit when the door assembly is in the closed position, and the electrical contacts are not electrically connected to each other with the electrical conduit when the door assembly is in the open position.

11. The water heater of claim 10, wherein the electrical component includes a plug, the electrical contacts being at least partially positioned within the plug.

12. The water heater of claim 11, wherein the insulating cap includes a socket, the electrical conduit being at least partially positioned in the socket.

13. The water heater of claim 12, wherein the plug is positioned within the socket when the door assembly is in the closed position and wherein the plug is not positioned within the socket when the door assembly is in the open position.

14. A water heater comprising:

a tank defining a water chamber, the tank including an outer surface;

a component coupled to the outer surface of the tank;

a jacket surrounding the tank, the jacket including an opening providing access to the component; and a door assembly that includes a door and a dam connected to the door for movement with the door, the dam having an inner surface, wherein the inner surface of the dam seals against the outer surface of the tank when the door is connected to the jacket to close the opening, and position the dam to protect the component during injection of insulating foam between the tank and the jacket, and wherein the dam is separated from the outer surface of the tank when the door is disconnected and separated from the jacket.

15. The water heater of claim 14, wherein the component is an electrical component.

16. The water heater of claim 14, wherein the electrical component extends outwardly from the outer surface of the tank, and wherein the dam includes a cavity, the dam being positioned to protect the component within the cavity during injection of insulating foam between the tank and the jacket.

17. The water heater of claim 14, wherein the dam is made from a ceramic foam.

18. The water heater of claim 14, wherein the dam is coated with a releasing agent when the insulating foam is injected between the tank and the jacket.

19. The water heater of claim 14, wherein the dam is molded to the door.

20. A method for manufacturing a water heater, the method comprising:

providing a tank defining a water chamber and including an outer surface;

providing a component coupled to the outer surface of the tank;

providing a jacket surrounding the tank and including an opening providing access to the component;

providing a door assembly that includes a door and a dam connected to the door for movement with the door, the dam having an inner surface;

connecting the door to the jacket to close the opening;

sealing the inner surface of the dam against the outer surface of the tank when the door is connected to the jacket to close the opening;

after sealing the inner surface, injecting foam between the tank and the jacket and around the dam to provide insulation between the tank and the jacket;

protecting the component from the injected foam with the dam;

disconnecting and separating the door from the jacket; and separating the dam from the outer surface of the tank when the door is disconnected and separated from the jacket.

21. The method of claim 20, wherein providing a component includes providing an electrical component.

22. The method of claim 20, wherein providing a component includes providing a component that extends outwardly of the outer surface of the tank, wherein providing a door assembly includes providing a door assembly that includes a dam having a cavity, and wherein protecting the component includes protecting the component within the cavity from the injected foam with the dam.

23. The method of claim 20, further comprising:

coating the dam with a release agent prior to the injecting step so that the injected foam does not bond with the dam allowing the cover assembly to be detached from the jacket.

24. A water heater comprising a tank defining a water chamber, the tank including an outer surface;

an electrical component coupled to the outer surface of the tank, the electrical component extending from the outer surface of the tank;

an electrical circuit electrically connected to the electrical component, the electrical circuit providing electricity to the electrical component when the electrical circuit is closed and not providing electricity to the electrical component when the electrical circuit is open;

a jacket surrounding the tank, the jacket including an opening providing access to the electrical component;

a door assembly movable between an open position in which the door assembly provides access to the electrical component and a closed position in which the door assembly restricts access to the electrical component, wherein the door assembly includes a door, a dam connected to the door for movement with the door, the dam having an inner surface, and a connecting device closing the electrical circuit when the door assembly is in the closed position and opening the electrical circuit when the door assembly is in the open position, wherein the inner surface of the dam seals against the outer surface of the tank when the door is connected to the jacket to close the opening and position the dam to protect the component during injection of insulating foam between the tank and the jacket, and wherein the dam is separated from the outer surface of the tank when the door is disconnected and separated from the jacket.

25. A water heater comprising:

a tank defining a water chamber, the tank including an outer surface;

a component coupled to the outer surface of the tank;

a jacket surrounding the tank, the jacket including an opening providing access to the component; and a door assembly that includes a dam having an inner surface, wherein the inner surface of the dam seals against the outer surface of the tank when the door assembly closes the opening, the dam being positioned to protect the component during injection of insulating foam between the tank and the jacket, and wherein the dam is coated with a releasing agent when the insulating foam is injected between the tank and the jacket.

26. A method for manufacturing a water heater, the method comprising:

providing a tank defining a water chamber and including an outer surface;

providing a component coupled to the outer surface of the tank;

providing a jacket surrounding the tank and including an opening providing access to the component;

providing a door assembly that includes a dam having an inner surface;

sealing the inner surface of the dam against the outer surface of the tank;

after sealing the inner surface, injecting foam between the tank and the jacket and around the dam to provide insulation between the tank and the jacket;

protecting the component from the injected foam with the dam; and coating the dam with a release agent prior to the injecting step so that the injected foam does not bond with the dam allowing the cover assembly to be detached from the jacket.

* * * * *